United States Patent [19]

Angot et al.

[11] Patent Number: 4,773,217

[45] Date of Patent: Sep. 27, 1988

[54] EARTHMOVING MACHINE

[75] Inventors: Daniel M. Angot, Liancourt; Francois R. Degraeve, Pont Sainte Maxence, both of France

[73] Assignee: CMI Europe S.A., Rantigny, France

[21] Appl. No.: 26,976

[22] Filed: Mar. 17, 1987

[51] Int. Cl.[4] ..... F16D 31/02; E01C 19/38

[52] U.S. Cl. ..... 60/444; 60/487; 60/488; 60/494; 404/133

[58] Field of Search ..... 404/133, 130, 102; 60/443, 444, 462, 465, 468, 494, 487, 488

[56] References Cited

U.S. PATENT DOCUMENTS

| | | | |
|---|---|---|---|
| 3,964,834 | 6/1976 | Paramythioti | 404/84 |
| 4,184,334 | 1/1980 | Orth | 60/445 |
| 4,310,261 | 1/1982 | Opderbeck | 404/117 |
| 4,400,939 | 8/1983 | Moranduzzo et al. | 60/444 X |
| 4,458,485 | 7/1984 | Seelmann | 60/444 X |

FOREIGN PATENT DOCUMENTS

| | | |
|---|---|---|
| 2259943 | 8/1975 | France . |
| 1558613 | 1/1980 | United Kingdom . |

*Primary Examiner*—Edward K. Look

*Attorney, Agent, or Firm*—Charles E. Brown; Charles A. Brown

[57] ABSTRACT

An earthmoving machine comprises a first system for moving the machine, a second system for moving a mobile part of the machine, and an actuator device for the first or second system. The actuator device comprises a variable flowrate pump and a mechanism for adjusting the flowrate of the pump. A ram is mechanically coupled to this mechanism, and a hydraulic control circuit controlling the pump comprises a control pressure generator, an actuator member coupled to the generator and a variable ratio pressure divider connected between the generator and the actuator member. The first or second system comprises at least one control member adapted to be actuated by the actuator member when the actuator member has moved a predetermined distance beyond a neutral point.

6 Claims, 1 Drawing Sheet

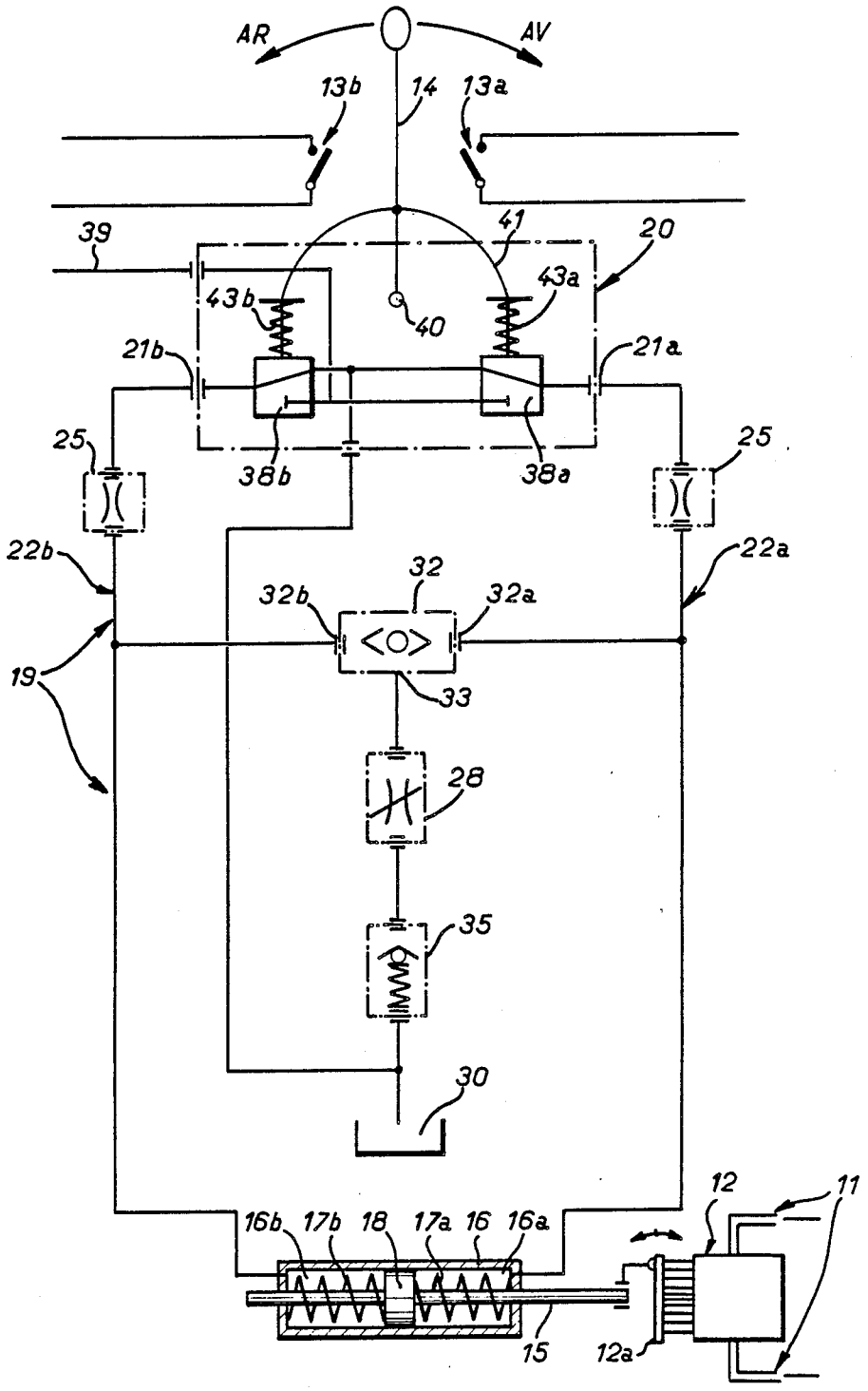
AR
AV
13b
14
13a
39
41
20
43b
43a
40
21b
21a
25
25
38b
38a
22b
22a
32
32b
32a
19
33
28
35
30
12
11
16b
17b
18
17a
16
16a
15
12a

EARTHMOVING MACHINE

BACKGROUND OF THE INVENTION

1. Field of the Invention

The invention relates to an earthmoving machine comprising two main subsystems: first means for moving it and second means for moving a mobile part of it. The invention is more particularly concerned with an improvement providing a specific way of synchronizing said first and second means. The invention finds a specific application in machines for compacting the soil where a vibrating system is carried by the machine which moves to and fro along a specific route. In this non-limiting example the invention makes it possible to avoid the generation of vibrations when the machine is stationary likely to result in localized excessive compacting.

2. Description of the Prior Art

A vibrating compactor is a rolling machine that has to execute a particular number of to and fro movements over the soil to be compacted at a predetermined speed chosen to suit the nature of the soil and using vibration means mounted on the machine. To maintain homogeneous compacting and a regular appearance of the surface treated, it is important to start and stop the machine under specific conditions. Starting and stopping have to be gradual to avoid excessive loads on one or other of the two axles of the machine due to the driving torque. As already mentioned, it is also very important to avoid vibrations when stationary. To this end the vibration has to be initiated after the machine has actually moved off and stopped before the machine actually comes to rest.

The conventional way to control movement of the machine uses a swinging lever with a central neutral point to select both the direction of displacement of the machine and the speed at which this occurs. As already mentioned, the machine moves at a speed chosen to suit the nature of the soil. Thus the operator has to move the lever gradually to a position in one direction or the other corresponding to the chosen speed. Also, the vibration means are actuated by a control member situated in the vicinity of the path of movement of the lever so as to be engaged by the lever as soon as the operator commands starting of the machine. The control member is placed in the immediate vicinity of the neutral point of the lever so that the vibration means can function at low displacement speeds of the machine. This results in the risk of compacting when stationary if the operator is not totally familar with the controls of the machine.

The objective of the invention is to facilitate starting and stopping the machine irrespective of the maximum speed chosen and to eliminate the risk of vibration when stationary or moving at very low speeds, by moving the control member for the vibration means to a significant distance from the neutral point of the aforementioned lever. This two-fold advantage is achieved in accordance with the invention by providing the facility to preselect the maximum speed of displacement of the machine and to establish a correspondence between this maximum speed and the maximum travel of the aforementioned lever.

SUMMARY OF THE INVENTION

The present invention consists in an earthmoving machine comprising first means for moving said machine, second means for moving a mobile part of said machine, and an actuator device for said first or second means, said actuator device comprising a variable flowrate pump, a mechanism for adjusting the flowrate of said pump, a piston-and-cylinder actuator mechanically coupled to said mechanism, and a hydraulic control circuit controling said pump and comprising a control pressure generator, an actuator member coupled to said generator, and a variable ratio pressure divider connected between said generator and said actuator member, said first or second means comprising at least one control member adapted to be actuated by said actuator member when said actuator member has moved a predetermined distance beyond a neutral point.

In the specific case mentioned above of a soil compacting machine the aforementioned first means for moving the machine will be actuated by the variable flowrate pump while the second means for vibrating a mobile part of the machine will be controled by the at least one control member disposed along the travel of the lever. The particular description to be given later will apply to this type of machine.

However, there are other earthmoving machines for which the arrangement may be reversed. For example, a scraper-loader may be equipped with the hydraulic control circuit defined above to drive progressively the high-inertia rotor consisting of the scraper blade assembly, slow translational movement of the machine being initiated by a control member facing the travel of the lever serving to adjust the speed of said blade assembly when this reaches a preselected rotation speed. In a machine of this kind translational movement is always very slow and at a single preselected speed or a single one of a plurality of preselected speeds. Thus the invention as defined above is applicable to this type of machine when the second means are actuated by the variable flowrate pump and the first means serving to move the machine are controled by the at least one control member.

The invention will be better understood and other advantages of the invention will emerge more clearly from the following description of a preferred embodiment of soil compacting machine in accordance with the invention given by way of example only and with reference to the appended drawing.

BRIEF DESCRIPTION OF THE DRAWING

The single FIGURE is a block diagram showing the system for controling the means for moving the machine and the vibration means carried by the machine.

DESCRIPTION OF THE PREFERRED EMBODIMENT

Referring to the drawing, there is shown a hydraulic control circuit of a soil compacting machine in accordance with the invention. This machine, which is of the conventional type and therefore not shown, comprises two main subsystems, first means for moving it and actuated by a hydraulic circuit 11 fed by a variable flowrate pump 12, of the plate pump type, and second means for vibrating a mobile part controled by an electrical circuit including two control members 13*a*, 13*b*. These are electrical contactors disposed to be operated mechanically by a progressive actuator member such as a lever 14 controling the speed of displacement of the machine, in forward motion or in reverse motion, when moved to the respective side of a central neutral position. In the drawing the lever 14 is shown in the central neutral position. Consequently, in forward motion (marked AV on the diagram) the vibration means are actuated by the control member 13*a* whereas in reverse motion (marked AR on the diagram) the same vibration means are actuated by the control member 13*b*. The flowrate of the plate pump 12 is adjusted in the conventional way by the inclination of the plate 12*a* coupled to one end of the piston rod 15 of a double-acting hydraulic ram 16. The piston 18 of this ram is urged towards a central position inside the body of the ram by two oppositely directed springs 17*a*, 17*b* situated in the respective ram chambers 16*a*, 16*b*. When the lever 14 is at its neutral position the plate 12*a* is in a position such that the flowrate of the pump 12 is zero or minimum.

An increase in the pressure in a chamber 16*a* or 16*b* tilts the plate in a given direction and consequently commands the flowrate in the circuit 11, for a corresponding direction of circulation, the speed of the machine being proportional to this flowrate. In the same way, an increase in the pressure in the other chamber tilts the plate in the other direction and the flowrate in the circuit 11 is consequently reversed, which changes the direction of displacement of the machine, the displacement speed being proportional to the flowrate.

The ram 16 is fed by a hydraulic control circuit 19 controled by the lever 14 and comprising a pressurized fluid distributor 20 (having two outlets 21*a*, 21*b*) and two distribution branches 22*a*, 22*b* respectively connected between outlets 21*a*, 21*b* and a chamber 16*a*, 16*b* of the ram 16. Each branch 22*a* or 22*b* comprises at least one fixed restriction 25 having its outlet opposite the distributor 20 connected to a variable restriction 28 on a branch connection to a reservoir 30. In this instance the restriction 28 is common to the two branches and connected to them by a check valve 32 having two inlets 32*a*, 32*b* connected to the respective branches and an outlet 33 connected to the restriction 28. This is a known device arranged to provide communication between the outlet 33 and either the inlet 32*a* or the inlet 32*b*, whichever is subject to the higher pressure. This type of valve is also known in this art as a "shuttle valve". It is to be understood that it would be possible to eliminate this valve and provide two restrictions 28 in respective branch connections from each branch 22*a*, 22*b*.

There is thus defined in each branch 22*a*, 22*b* a variable ratio pressure divider connected between the pressure generator 20 and each chamber of the ram 16 in such a way that the pressure, increasing in proportion to the required speed and delivered to an outlet 21*a* or 21*b*, is at all times divided down in a predetermined ratio before it is applied to the ram so as to determine at will the maximum speed (corresponding to the maximum travel of the lever 14 in the AV or AR direction) at which the machine is authorized to move. This makes it possible to place the control members 13*a* and 13*b* at a specific distance from the neutral point of the lever 14 so that they can only be actuated by the lever 14 after the latter has moved a predetermined distance from its neutral point. In practise each control member is placed to be operated by the lever 14 at between approximately 60% and 90% of its travel from the neutral point in the corresponding direction.

A calibrated valve 35 is connected in series with the variable restriction 28, between the latter and the reservoir 30. This valve imposes a minimum threshold pressure for the pressure division and so that the pump safety threshold is achieved in all cases.

The pressure generator 20 comprises two proportional valves 38*a*, 38*b* of known type receiving a pressurized fluid applied to a control pressure inlet 39 of the generator 20 and establishing hydraulic circulation between the outlets 21*a* 21*b*, on the one hand, and the reservoir 30, on the other hand, so that the pressure available at the outlet 21*a* or 21*b* concerned is representative of the movement of the lever 14 in the chosen direction. The lever, pivoted at 40, is coupled to a linkage 41 operating the slide members of valves 38*a*, 38*b*. This linkage is also coupled to springs 43*a*, 43*b* biasing the lever 14 to its central neutral point.

How the system functions is obvious from the foregoing description. As in the past, the driver has a lever controling the speed in forward motion and in reverse motion (the lever 14) for controling the displacement of the machine and two control members 13*a*, 13*b* functionally linked to the lever 14. However, in accordance with the invention these control members 13*a* and 13*b* are placed so as to be operated towards the end of the travel of the lever 14 while the driver has an additional adjustment (the variable restriction 28) enabling him to program the maximum speed of displacement of the machine. Consequently, starting from the neutral point inclination of the lever 14 in one direction or the other leads to the starting and gradual acceleration to speed of the machine in the required direction up to a maximum value set by the pressure divider of the branch 22*a* or 22*b*, that is to say by adjustment of the restriction 28. Near the end of the travel of the lever one of the electrical contactors 13*a* or 13*b* is operated which starts up the vibration means. Thus vibration is started when the speed of the machine is close to the selected working speed, and thus with the certainty that the machine is actually moving. Likewise, the vibration is halted when the machine is still at a speed near its working speed, which gives the vibration means sufficient time to stop, given their inertia, before the machine stops. An internal time-delay system may also be provided for the pump 12 to prevent any sudden variation in the flowrate in the circuit 11. In this case, the lever may even be operated brutally by an inexperienced driver; the machine will react with some degree of inertia to commands and the vibrations will stop before the machine actually halts.

There is claimed:

1. Earthmoving machine comprising first means for moving said machine, second means for moving a mobile part of said machine, and an actuator device for said first means, said actuator device comprising a variable flowrate pump for actuating said first means, a mechanism for adjusting the flowrate of said pump, a piston-and-cylinder actuator mechanically coupled to said mechanism, and a hydraulic control circuit controling said pump and comprising a pressurized fluid distributor, an actuator member coupled to said distributor, and a variable ratio pressure divider connected between said distributor and said actuator member, said second means comprising at least one control member adapted to be actuated by said actuator member when said actuator member has moved a substantial predetermined distance beyond a neutral point.

2. Machine according to claim 1, further comprising at least one adjustable restriction and a reservoir connected to a first outlet of said adjustable restriction, and wherein said actuator member has a neutral point at the middle of its travel and is adapted to command a speed adjustment in forward motion for one direction of its movement and a speed adjustment in reverse motion for the opposite direction of its movement and said pressurized fluid distributor has two fluid outlets each delivering a pressure representative of movement of said actuator member in a respective direction and two distribution branches connected between respective fluid outlets and a chamber of said piston-and-cylinder actuator, each branch comprising at least one fixed restriction and a second outlet of said adjustable restriction being connected to an outlet of said fixed restriction.

3. Machine according to claim 2, wherein said adjustable restriction is common to said two branches and further comprising a check valve having two inlets each connected to a respective branch and an outlet connected to said adjustable restriction.

4. Machine according to claim 3, further comprising a calibrated valve in series with said adjustable restriction.

5. Machine according to claim 2, comprising two control members disposed on the travel of said actuator member, one on each side of said neutral point.

6. Machine according to claim 5, wherein each control member is disposed to be actuated by said actuator member after it has moved substantially 60% to 90% of its travel from said neutral point in the corresponding direction.

* * * * *